US006604593B1

(12) United States Patent
Mullet

(10) Patent No.: US 6,604,593 B1
(45) Date of Patent: Aug. 12, 2003

(54) POWERED ROLLER SKATES

(75) Inventor: Willis J. Mullet, Gulf Breeze, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 10/059,986

(22) Filed: Jan. 29, 2002

(51) Int. Cl.[7] ..... A63C 1/22; A63C 17/12

(52) U.S. Cl. ..... 180/181; 280/11.201; 280/811; 280/11.19

(58) Field of Search ..... 180/180, 181; 280/841, 87.042, 11.19, 11.201, 11.115, 11.204, 87.041, 11.208, 11.211, 11.215, 11.216, 11.224, 11.27, 811, 825

(56) References Cited

U.S. PATENT DOCUMENTS

| | | | | | |
|---|---|---|---|---|---|
| 823,385 | A | | 6/1906 | Beauford | |
| 1,672,700 | A | | 6/1928 | Vass | |
| 2,857,008 | A | | 10/1958 | Pirrello | 180/1 |
| 4,027,890 | A | * | 6/1977 | Volkmann | 280/11.207 |
| 4,069,881 | A | | 1/1978 | Shiber | 180/1 G |
| 4,073,356 | A | | 2/1978 | Schlicht | 180/1 G |
| 4,076,266 | A | | 2/1978 | Krausz | 280/87.04 A |
| 4,094,372 | A | | 6/1978 | Notter | 180/1 G |
| 4,143,728 | A | | 3/1979 | Shiber | 180/1 G |
| 4,167,225 | A | * | 9/1979 | Fragoso | 188/5 |
| 4,183,546 | A | | 1/1980 | Heilig | 280/87.04 A |
| 4,508,187 | A | | 4/1985 | Wenzel | 180/181 |
| 4,691,931 | A | * | 9/1987 | Vincent | 280/11.115 |
| 5,020,621 | A | | 6/1991 | Martin | 180/181 |
| 5,372,383 | A | | 12/1994 | Kubierschky | 280/842 |
| 5,403,021 | A | * | 4/1995 | Shifrin | 280/11.215 |
| 5,492,345 | A | * | 2/1996 | Kruczek | 280/11.115 |
| 5,797,466 | A | * | 8/1998 | Gendle | 180/181 |
| 5,826,674 | A | | 10/1998 | Taylor | 180/219 |
| 5,829,543 | A | * | 11/1998 | Diaz | 180/181 |
| 5,839,737 | A | * | 11/1998 | Kruczek | 280/11.115 |

* cited by examiner

*Primary Examiner*—Brian L. Johnson
*Assistant Examiner*—Brian Swenson
(74) *Attorney, Agent, or Firm*—Renner, Kenner, Greive, Bobak, Taylor & Weber

(57) ABSTRACT

A skate (10) includes a base plate (11) pivotally carrying a platform plate (14) which can be the sole of a shoe (16). There is an aperture (18) in the base plate (11) so that when the platform plate (14) is adjacent to the base plate (11), a pad (17) on the platform plate (14) extends through the aperture (18) so that the user may walk on the skate (10). A frame (23) carries a drive shaft (20) which carries drive wheels (19). The drive shaft (20) is journalled in unidirectional bearings (21) and has a gear (32) which engages a threaded motor shaft (31) of a motor (27). A collar (38) has threads (37) which engage the threads (36) of a motor housing (33). When the motor (27) rotates in the one direction permitted by the unidirectional bearings (21), the drive wheels (19) will power the skate (10). When, upon voice command, the motor (27) attempts to rotate the shaft (31) in the other direction, the motor (27) rotates so that the collar (38) moves relative to the housing (33) to move the pad (17) through the aperture (18).

19 Claims, 9 Drawing Sheets

POWERED ROLLER SKATES

TECHNICAL FIELD

This invention relates to motorized roller skates or the like. More particularly, this invention relates to such skates which upon a voice command may be transformed from a powered skating configuration to a walking configuration.

BACKGROUND ART

Many attempts have been made at powering items such as roller skates, skate boards and the like. Essentially, all such attempts have involved strapping a motor, or even a small combustion engine, to the body of the user, and through some type of drive cable, powering the wheels of the skates. These devices are, for the most part, not only heavy and uncomfortable, but also they involve numerous components which are difficult and costly to produce and assemble. As a result, the costs to the user far outweigh the benefit enjoyed by the utilization of powered skates.

In addition, in most of the prior art motorized devices, the user had very little, if any, braking or speed control. Of more importance, the skates could not be converted to walking devices at the whim of the user.

DISCLOSURE OF THE INVENTION

It is thus an object of the present invention to provide roller skates or the like which can be selectively powered at the desire of the user or which can be transformed for walking.

It is another object of the present invention to provide roller skates, as above, in which a shoe platform is pivotable from a walking configuration to a motorized skating configuration.

It is a further object of the present invention to provide roller skates, as above, which can be powered by a motor which is voice controlled to start, accelerate, decelerate, stop or convert to the walking configuration.

It is an additional object of the present invention to provide roller skates, as above, which can be powered without the need for the user to carry heavy motor components and without the need for drive cables.

It is yet another object of the present invention to provide roller skates, as above, which are constructed of a minimal number of components which are easily assembled and economically affordable for the user.

These and other objects of the present invention, as well as the advantages thereof over existing prior art forms, which will become apparent from the description to follow, are accomplished by the improvements hereinafter described and claimed.

In general, a skate made in accordance with one aspect of the present invention includes a base plate which carries drive wheels. A platform plate is pivotally connected to the base plate and has a pad thereon. An aperture is formed in the base plate. A motor is provided to drive the wheels. When the platform plate is adjacent to the base plate, the pad extends through the aperture of the base plate.

In accordance with another aspect of the present invention, the motor has a housing with external threads. A collar is provided with threads to engage the threads of the motor housing. When the motor is powered in one direction, the wheels are rotated, and when powered in the other direction, the motor rotates to lower the collar relative to the housing so that the platform plate may pivot relative to the base plate.

According to yet another aspect of the present invention, the wheels are carried by a drive shaft having a gear thereon. The motor has a threaded shaft which engages the gear of the drive shaft. The drive shaft is journalled in unidirectional bearings which allow the drive shaft to turn only in one direction to rotate the wheels when the motor is activated in one direction, and when the motor is activated in the other direction, the platform plate is pivoted relative to the base plate.

A preferred exemplary powered skate incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
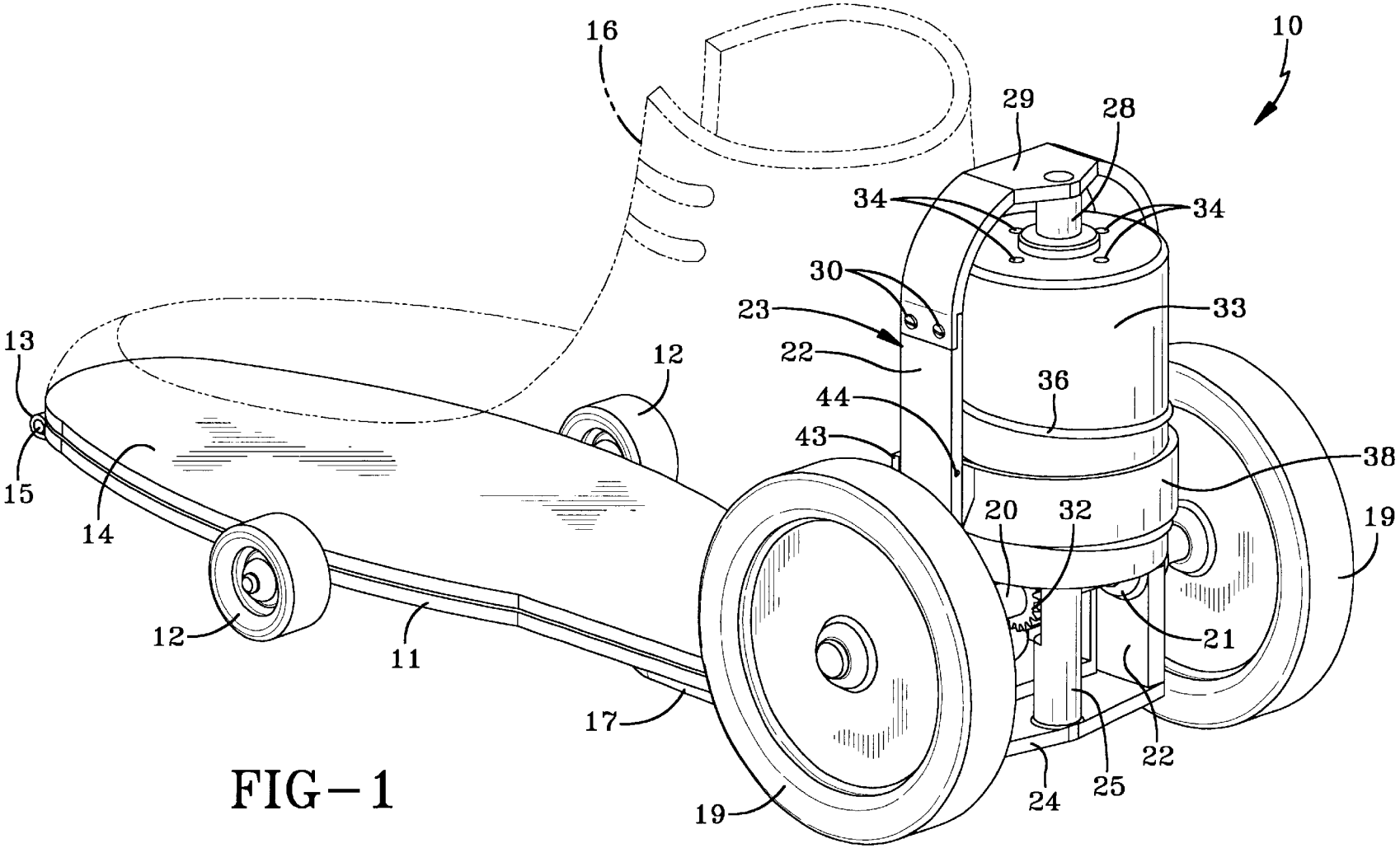
FIG. 1 is a top perspective view of a skate made in accordance with the present invention and being shown in the unpowered walking configuration with a shoe portion thereof being shown in phantom.

A skate made in accordance with the present invention is indicated generally by the numeral 10 in the drawings. Skate 10 includes a base plate 11 which is generally in the shape of a sole of a shoe and which carries rotatable front wheels 12. The front or toe of plate 11 carries a portion of a hinge-like assembly 13 so that a shoe platform plate 14 may be connected to plate 11 by a pin 15 of hinge assembly 13 for pivoting movement on pin 15 relative to plate 11. Shoe platform plate 14 is preferably the sole of a shoe 16 shown in phantom only in FIG. 1 for convenience, but it could be a stand alone plate to which any type of shoe of a user could be attached by any conventional means, such as straps or the like.

Shoe platform plate 14 includes a heel portion 17 which can extend through an aperture 18 formed in base plate 11 to serve as a walking pad when skate 10 is in the walking configuration shown in FIGS. 1 and 3–5. Thus, in the walking configuration, walking pad 17 is in contact with the ground. In this configuration, the larger, powerable, rear drive wheels 19 are off of the ground and inoperable to move skate 10 as will hereinafter be described.

Figure 2:
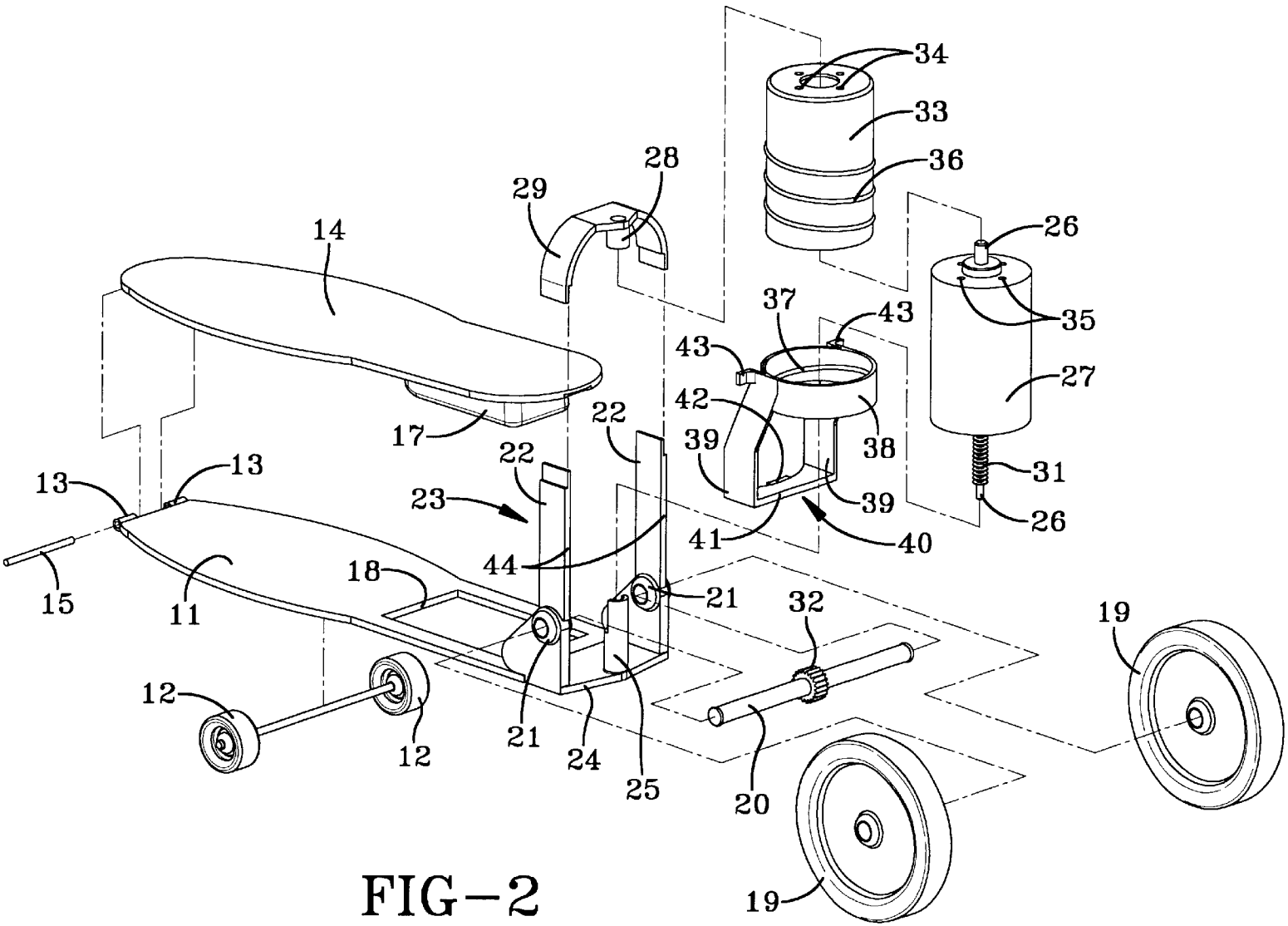
FIG. 2 is an exploded perspective view of the components of the skate made in accordance with the present invention.
Figure 3:
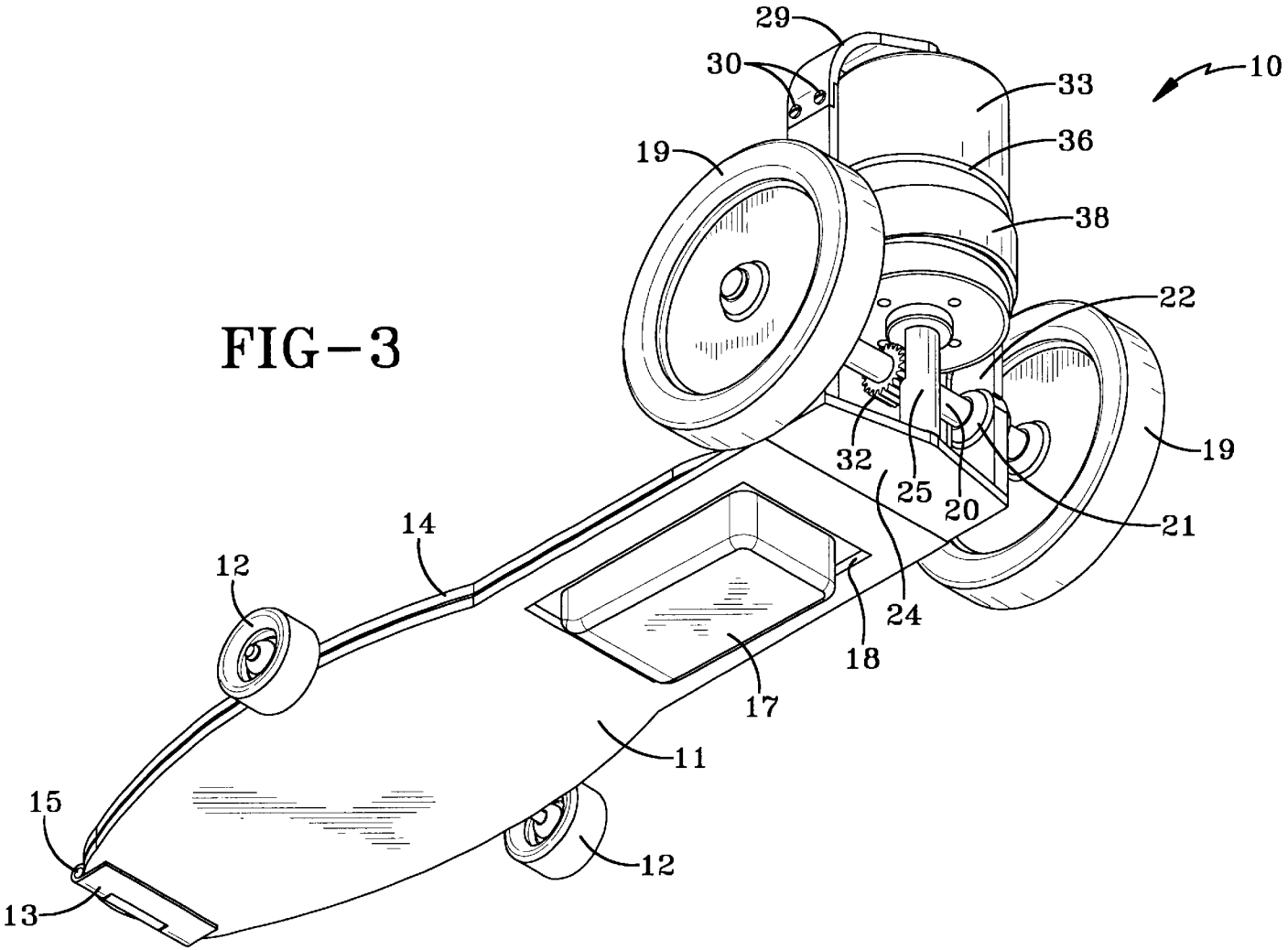
FIG. 3 is a bottom perspective view of the skate shown in the walking configuration of FIG. 1.

Wheels 19 are carried on a drive shaft 20 which is journalled in unidirectional bearings 21 which are positioned in the opposed upright branches 22 of a U-shaped frame generally indicated by the numeral 23 and carried by base plate 11. As is known to one skilled in the art, unidirectional bearings 21 will permit the rotation of drive shaft 20 in only one direction, in this instance, the forward direction, but will prohibit rotation in the other, backward, direction. U-shaped frame 23 also includes a base member 24 which interconnects the bottoms of upright branches 22 and carries a lower bearing support 25 for a shaft 26 of an electric motor 27 (FIG. 2). The upper end of motor shaft 26 is carried by an upper bearing support 28 formed in an arch 29 which is connected to the top of branches 22, as by screws 30. Bearing supports 25 and 28 thus prevent vertical movement of motor 27. A portion of motor shaft 26 is threaded to form a worm 31 which, as will hereinafter be more fully discussed, drives a wormgear 32 formed on drive shaft 20. The worm/wormgear is designed with a low lead angle to resist any tendency of the wormgear 32 to turn the worm 31.

Figure 6:
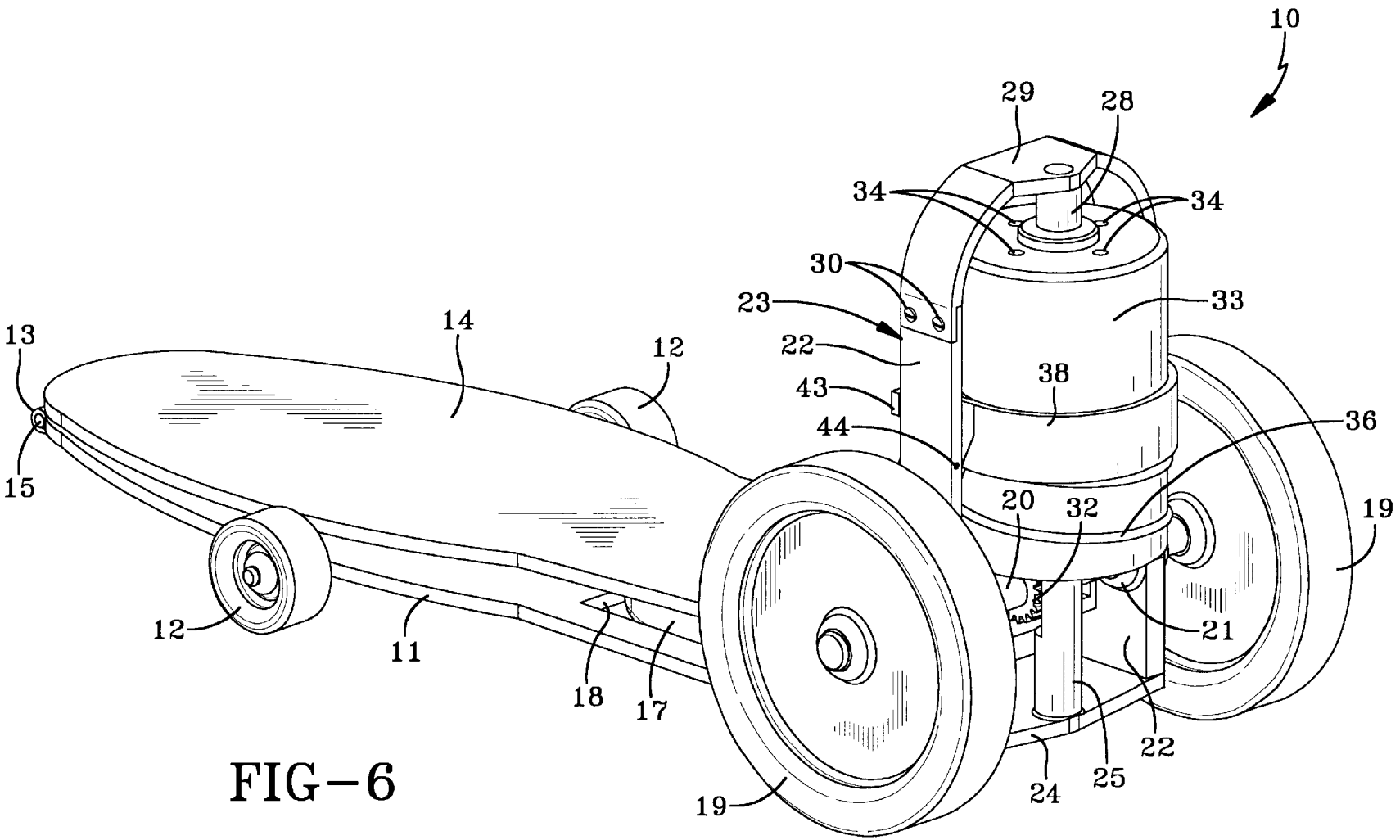
FIG. 6 is a top perspective view of the skate of FIG. 1 shown in the powered configuration.
Figure 7:
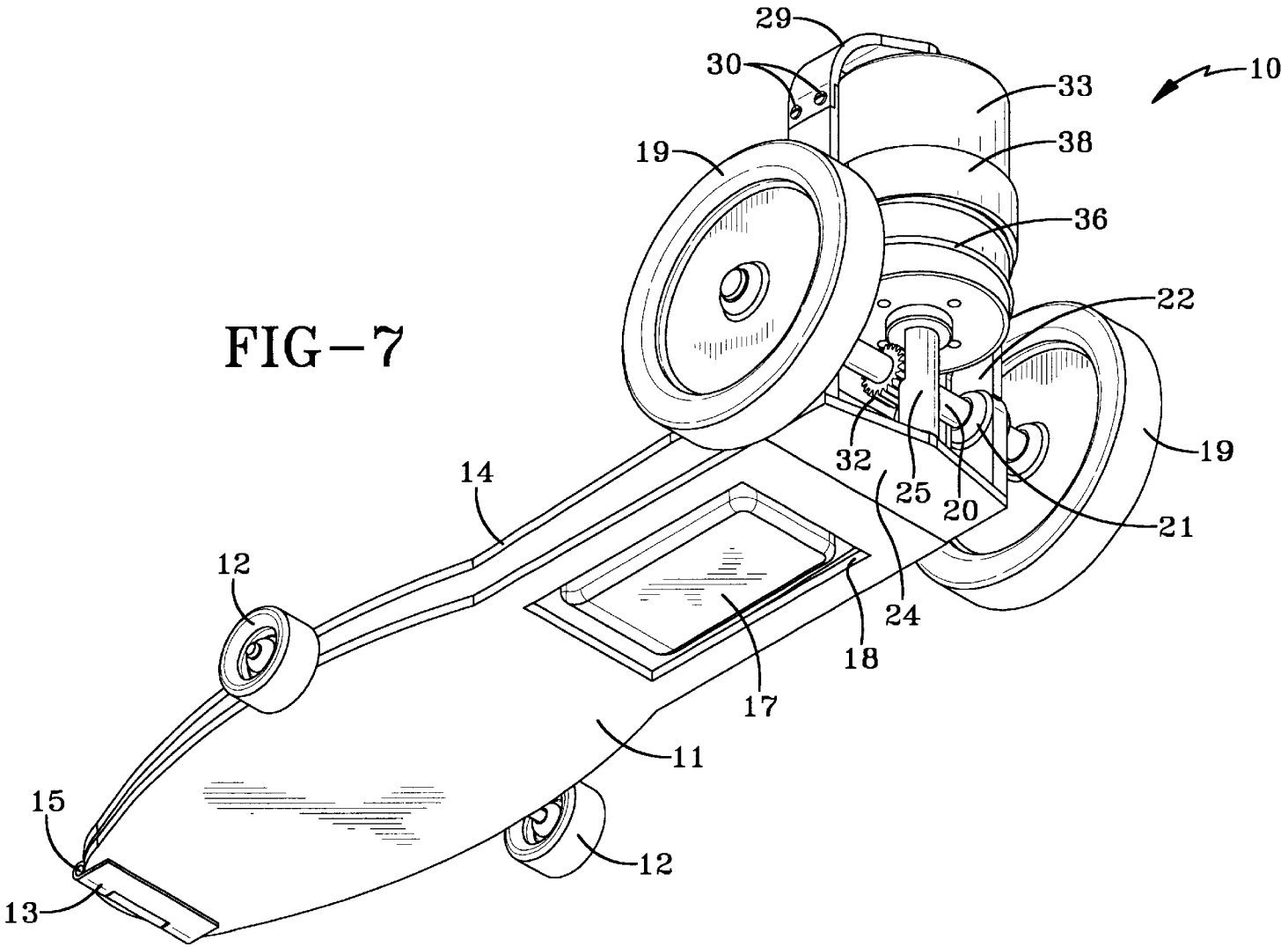
FIG. 7 is a bottom perspective view of the skate shown in the powered configuration of FIG. 6.

A motor housing 33 is received over motor 27 and attached thereto by fasteners (not shown) which extend through apertures 34 on the top of housing 33 and into apertures 35 (FIG. 2) on the top of motor 27. The external surface of housing 33 is provided with threads 36 for engagement with internal threads 37 (FIG. 2) on a collar 38. It should be appreciated that threads 36 could be formed directly on the exterior of motor 27, but it is preferred that a separate housing 33 be provided. Collar 38 is formed at the top of opposed branches 39 of a U-shaped frame generally indicated by the numeral 40. Frame 40 includes a base member 41 which interconnects the bottom of branches 39. Base member 41 includes a tab 42 extending laterally therefrom. As probably best shown in FIG. 5A, tab 42 underlies the heel end of shoe platform plate 14 and, as will hereinafter be described, assists in the lifting of plate 14 to pivot it from the FIG. 1 to the FIG. 6 position and to thereafter hold it in the FIG. 6 position. The top of each branch 39 of frame 40 is provided with an ear 43. The opposed ears 43 are adapted to engage spring loaded ball detents 44 formed in branches 22 of frame 23 at various times during the operation of motor 27 as will hereinafter be described.

Electric motor 27 may be battery powered with the batteries conveniently carried by the user, as on his shin guards or the like. In addition, it is preferred that motor 27 be voice activated by means of a conventional voice control module associated with motor 27. Thus, as one skilled in the art would appreciate, the module can be programmed to recognize such words as "start," "stop," "faster," "slower" and the like so that the user can control motor 27 accordingly.

Figure 4:
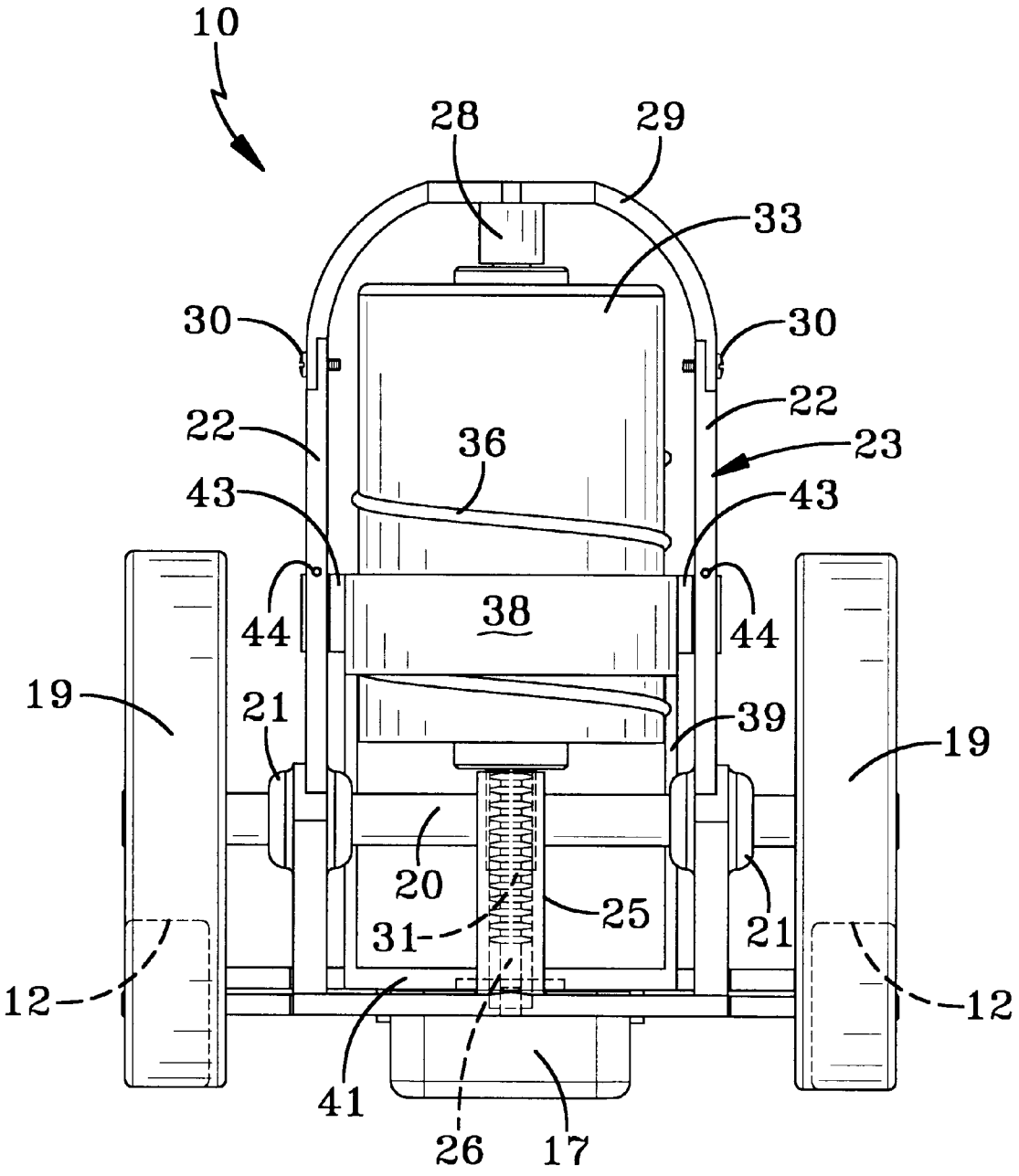
FIG. 4 is a rear elevational view of the skate shown in the walking configuration of FIG. 1.
Figures 5, 5A:
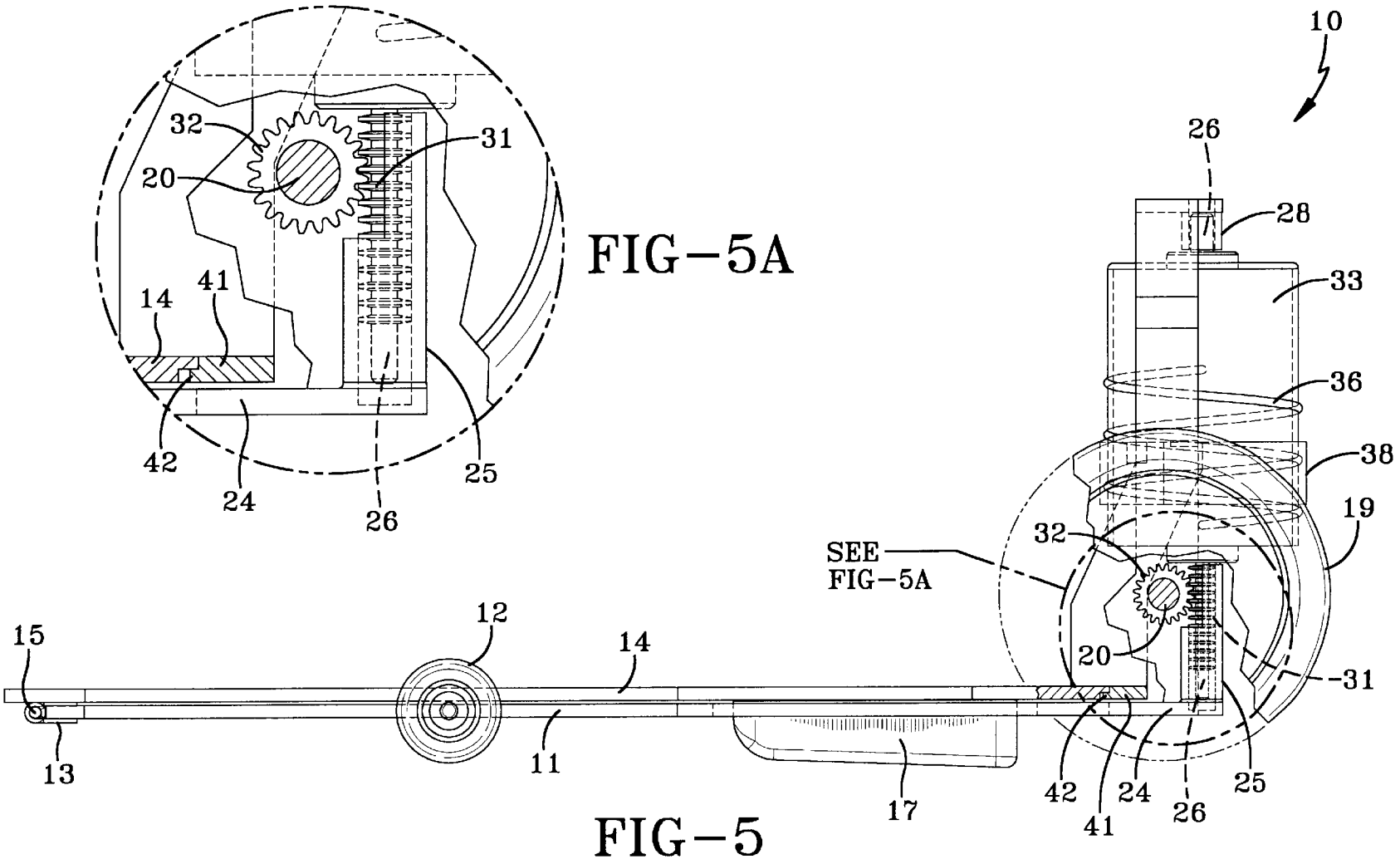
FIG. 5 is a partially broken away side elevational view of the skate shown in the walking configuration of FIG. 1.
FIG. 5A is an enlargement of a portion of the skate shown in FIG. 5.
Figure 8:
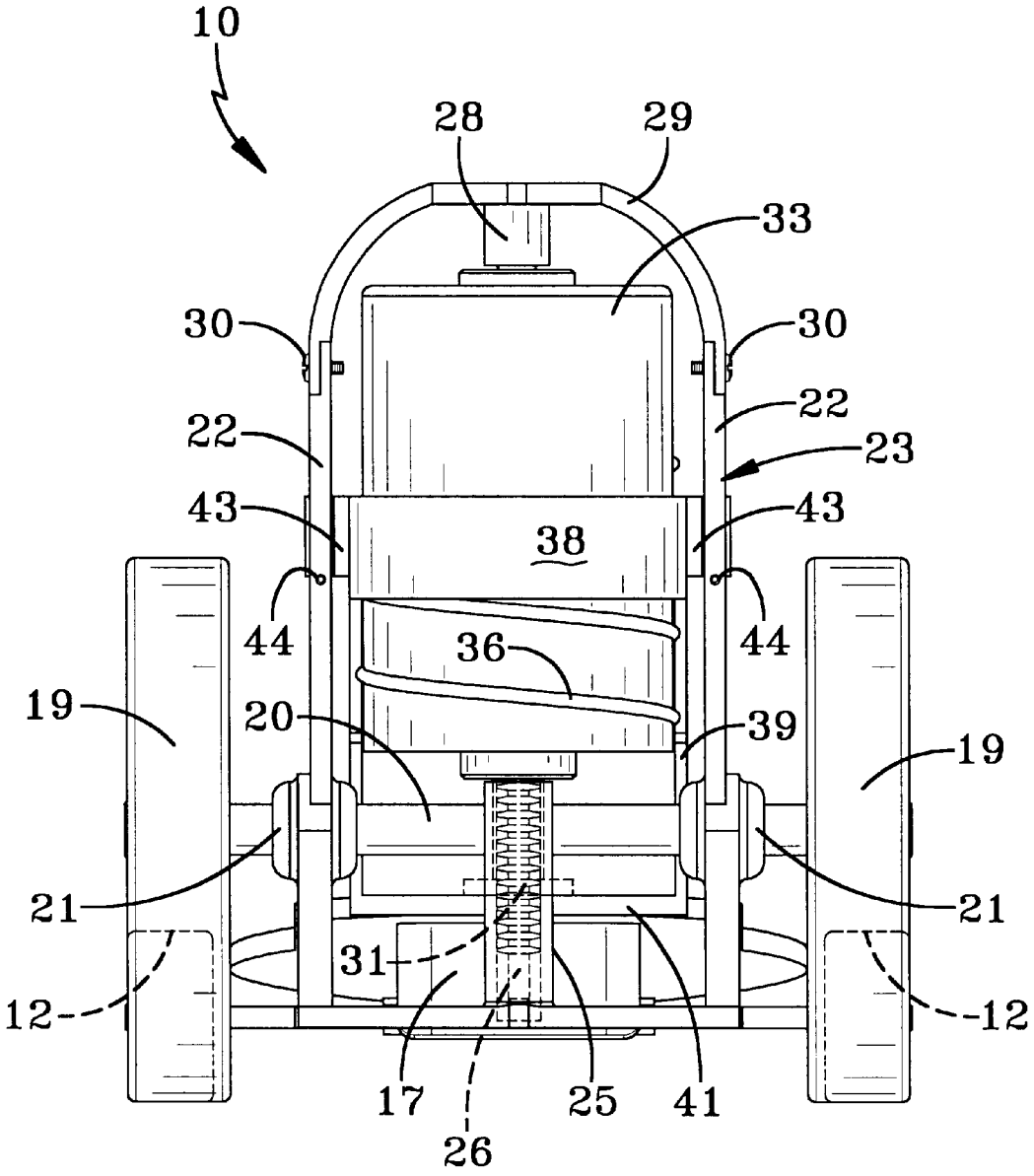
FIG. 8 is a rear elevational view of the skate shown in the powered configuration of FIG. 6.
Figure 9:
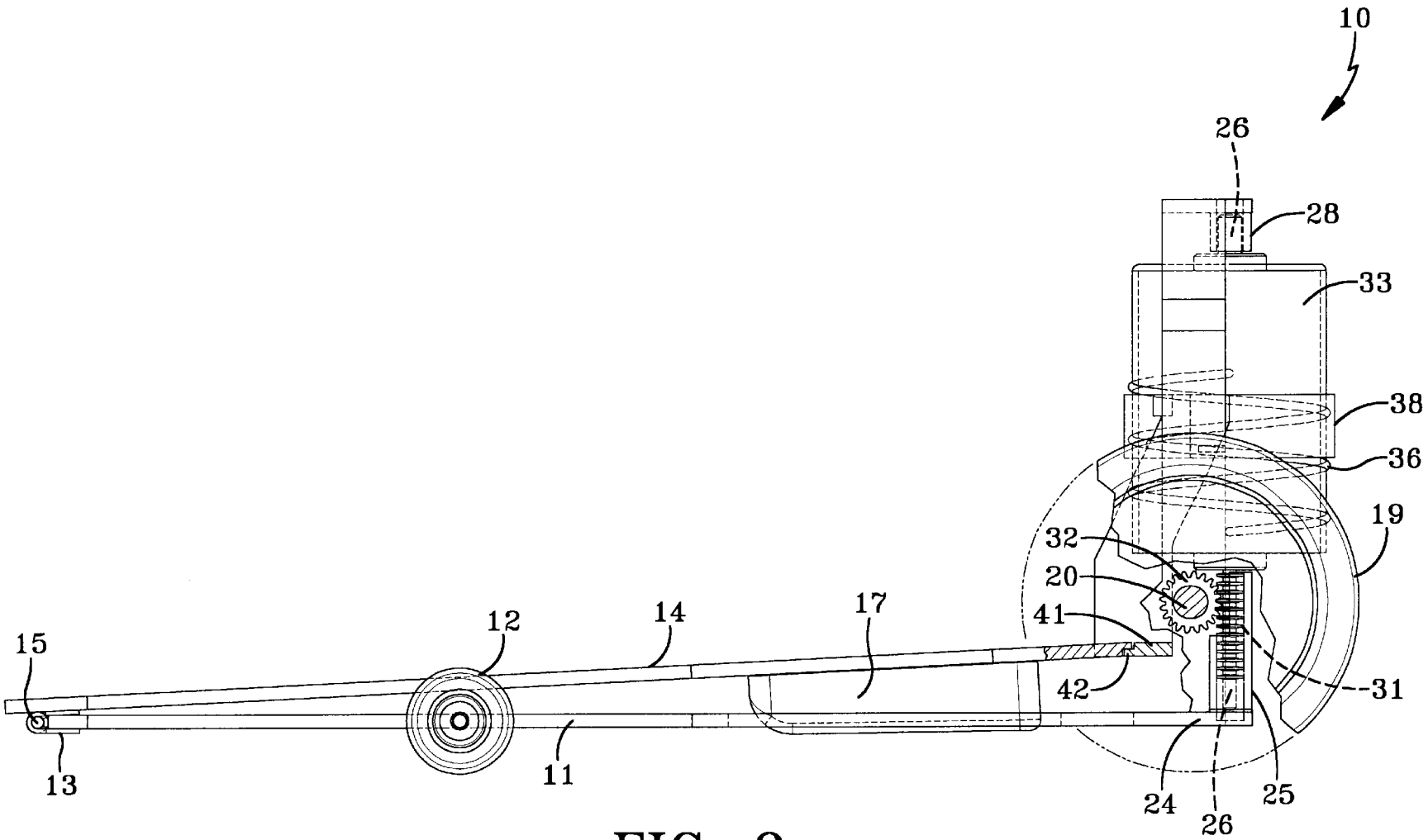
FIG. 9 is a partially broken away side elevational view of the skate shown in the powered configuration of FIG. 6.

When the pivoting plate 14 is in the lower position shown in FIGS. 1 and 3–5, the user may walk with skates 10, pad 17 engaging the ground and maintaining wheels 19 off of the ground. Plate 14 is assisted in being maintained in the lower position by virtue of the fact that detents 44 are positioned just above ears 43 of frame 40, as shown in FIG. 4. When plate 14 is in the upper position, as shown in FIGS. 6–9, pad 17 is off of the ground and wheels 19 are on the ground, allowing the user to move by means of the power provided by motor 27 to wheels 19. Detents 44 assist in maintaining this position in that they are now positioned just below ears 43 of frame 40 as shown in FIG. 8.

When the user is moving on skates 10, threaded worm 31 of motor shaft 26 acts on wormgear 32 so that shaft 20 is rotating in the forward direction permitted by unidirectional bearings 21. When the command is given to stop, motor 27 momentarily reverses direction, but because bearings 21 will not allow shaft 20 to rotate in the reverse direction, motor 27 and its threaded housing 33 will actually rotate one revolution causing collar 38 to overcome detents 44 and move downwardly to lower pivoting plate 14 to position pad 17 on the ground.

When the voice command is given to start motor 27, housing 33 will rotate when some friction is exerted on wheels 19, as by the user leaning forward and/or tilting the skate to either side to pivot plate 14 relative to plate 11 and to raise pad 17 so that at least one of the wheels 19 touches the ground. In addition, the initial rotation of motor 27 overcomes the retention force of detents 44, with the motor 27 and housing 33 rotating within collar 38 to move collar 38 upwardly to the FIG. 8 position.

It should thus be evident that a powered skate constructed as described herein accomplishes the objects of the present invention and otherwise substantially improves the art.

What is claimed is:

1. A skate comprising a base plate, drive wheels carried by said base plate, a platform plate pivotally connected to said base plate, an aperture in said base plate, a pad on said platform plate, said aperture being sized to permit said pad to be positioned therein, and a motor to drive said wheels, said motor being supported by said base plate, said pad being positioned within and extending through said aperture so that said pad is adapted to engage the ground when said platform plate is adjacent to said base plate.

2. A skate comprising a base plate, drive wheels carried by said base plate, a platform plate pivotally connected to said base plate, an aperture in said base plate, a pad on said platform plate, a motor to drive said wheels, said motor having a housing with external threads, and a collar having threads engaging said threads of said housing such that when said motor is powered in one direction said wheels are rotated and when powered in the other direction said collar is lowered relative to said housing so that said platform plate may pivot relative to said base plate, said pad extending through said aperture when said platform plate is adjacent to said base plate.

3. A skate comprising a base plate, drive wheels carried by said base plate, a platform plate pivotally connected to said base plate, an aperture in said base plate, a pad on said platform plate, a motor to drive said wheels, said motor having a threaded shaft, and a drive shaft journalled in unidirectional bearings and carrying said wheels, said drive shaft having a gear engaging said threaded shaft, said unidirectional bearings allowing said drive shaft to turn in one direction to rotate said wheels when said motor is activated in one direction, and when said motor is activated in the other direction, said platform plate is pivoted relative to said base plate, said pad extending through said aperture when said platform plate is adjacent to said base plate.

4. The skate according to claim 1 wherein said platform plate is the sole of a shoe.

5. The skate according to claim 1 wherein the base plate carries front wheels.

6. The skate according to claim 1 wherein said motor drives said wheels upon voice command.

7. A skate comprising a base plate, drive wheels carried by said base plate, a platform plate pivotally connected to said base plate, a motor having a housing with external threads, and a collar having threads engaging said threads of said housing, said motor when powered in one direction rotating said wheels and when powered in the other direction rotating to move said collar relative to said housing so that said platform plate may pivot relative to said base plate.

8. The skate according to claim 7, said motor having a threaded shaft and further comprising a drive shaft journalled in unidirectional bearings and carrying said wheels, said drive shaft having a gear engaging said threaded shaft, said unidirectional bearings allowing said drive shaft to turn in said one direction.

9. The skate according to claim 7, further comprising a frame carrying said collar.

10. The skate according to claim 9 wherein said frame includes a tab which can engage said platform plate.

11. The skate according to claim 9 further comprising a second frame carried by said base plate and carrying said drive wheels.

12. The skate according to claim 11 wherein the second frame carries at least one detent and said frame includes at least one ear, said detent acting against said ear to maintain said collar positioned relative to said housing.

13. The skate according to claim 7 wherein the powering of said motor in said one direction or said other direction is controlled by voice command.

14. A skate comprising a base plate, a drive shaft, drive wheels carried by said drive shaft, a platform plate pivotally connected to said base plate, a motor having a threaded shaft, and a gear on said drive shaft engaging said threaded shaft, said drive shaft being journalled in unidirectional bearings allowing said drive shaft to turn in one direction to rotate said wheels when said motor is activated in one direction and when said motor is activated in the other direction, said platform plate is pivoted relative to said base plate.

15. The skate according to claim 14 further comprising a frame carrying said unidirectional bearings.

16. The skate according to claim 15 further comprising a motor bearing support carried by said frame and receiving one end of said threaded shaft.

17. The skate according to claim 16 further comprising an arch connected to said frame, and a second motor bearing support carried by said arch and receiving the other end of said threaded shaft.

18. The skate according to claim 14 wherein the powering of said motor in said one direction or said other direction is controlled by voice command.

19. A skate comprising a base plate, a drive shaft, drive wheels carried by said drive shaft, a platform plate pivotally connected to said base plate, an aperture in said base plate, a pad on said platform plate, a motor having a housing with external threads and having a threaded shaft, a collar having threads engaging said threads of said housing, and a gear on said drive shaft engaging said threaded shaft of said motor, said drive shaft being journalled in unidirectional bearings allowing said drive shaft to turn in one direction to rotate said wheels when said motor is activated in the one direction, and when said motor is activated in the other direction said collar moves relative to said housing so that said platform plate may pivot relative to said base plate so that said pad extends through said aperture when said platform plate is adjacent to said base plate.

* * * * *